US005771861A

United States Patent [19]

Musser et al.

[11] Patent Number: 5,771,861

[45] Date of Patent: Jun. 30, 1998

[54] APPARATUS AND METHOD FOR ACCURATELY CONTROLLING FUEL INJECTION FLOW RATE

[75] Inventors: Keith L. Musser, Cloumbus; Daniel D. Wilhelm, Nashville; David A. Olson, Columbus, all of Ind.; James H. Ross, Cedar Falls, Iowa; Jeffrey P. Seger, Columbus, Ind.; Michael J. Ruth, Franklin, Ind.; Prakash Bedapudi, Columbus, Ind.; David A. Bolis, Nashville, Ind.; Stephen M. Holl, Columbus, Ind.; Gregory Weber, Rochester Hills, Mich.

[73] Assignee: Cummins Engine Company, Inc., Columbus, Ind.

[21] Appl. No.: 674,280

[22] Filed: Jul. 1, 1996

[51] Int. Cl.[6] ..... F02D 31/00

[52] U.S. Cl. ..... 123/357; 364/431.052

[58] Field of Search ..... 123/357, 458, 123/510, 511, 456, 459; 364/431.052; 701/104

[56] References Cited

U.S. PATENT DOCUMENTS

| | | | |
|---|---|---|---|
| 4,503,820 | 3/1985 | Nakagawa . | |
| 4,565,173 | 1/1986 | Oshiage et al. . | |
| 4,643,147 | 2/1987 | Staerzl . | |
| 4,667,633 | 5/1987 | Stumpp et al. | 123/357 |
| 4,757,795 | 7/1988 | Kelly . | |
| 4,982,331 | 1/1991 | Miyazaki . | |
| 5,133,323 | 7/1992 | Treusch . | |
| 5,237,975 | 8/1993 | Betki et al. . | |
| 5,261,378 | 11/1993 | Fenchel et al. | 123/357 |
| 5,315,976 | 5/1994 | Birk et al. | 123/357 |
| 5,355,859 | 10/1994 | Weber . | |
| 5,379,741 | 1/1995 | Matysiewicz et al. . | |
| 5,411,002 | 5/1995 | Smitley . | |
| 5,483,940 | 1/1996 | Namba et al. . | |
| 5,485,822 | 1/1996 | Hirose et al. . | |
| 5,505,180 | 4/1996 | Otterman et al. . | |
| 5,553,589 | 9/1996 | Middleton et al. | 123/357 |
| 5,609,136 | 3/1997 | Tuken | 123/357 |
| 5,609,140 | 3/1997 | Kramer | 123/458 |

FOREIGN PATENT DOCUMENTS

| | | |
|---|---|---|
| 0209497 | 1/1987 | European Pat. Off. . |
| 6463649 | 9/1989 | Japan . |

*Primary Examiner*—Thomas N. Moulis
*Attorney, Agent, or Firm*—Sixbey, Friedman, Leedom & Ferguson; Eric J. Robinson; Charles M. Leedom, Jr.

[57] ABSTRACT

A system for controlling fuel flow in an internal combustion engine receives a command specifying a desired fuel flow rate from an electronic control module. The system generates a feedforward estimate of actuator current required to produce the desired flow rate. This estimate is combined with a fueling current offset value generated using a proportional-integral feedback controller. A differential pressure between the fuel rail and cylinder gas is converted, by surface interpolation based on a lookup table, to an estimate of actual fuel flow rate. The difference between this actual fuel flow rate and the desired flow rate is provided to the feedback controller as an error signal. The feedback controller preferably uses different gain values depending on an operating mode of the engine (speed control and torque control modes).

52 Claims, 4 Drawing Sheets

200

202
FUEL TO CURRENT TABLE
204
LEAD COMP.
ESTIMATED CURRENT
206
208
FUELING PI CONTROLLER
210
212
CURRENT CONTROL
224
ENGINE
D
214
FUEL COMMAND
ESTIMATED FUELING
216
PRESSURE TO FUEL TABLE
218
220
PRESSURE ADJUSTMENT
AVERAGE ENGINE SPEED
AVERAGE ENGINE SPEED
226
222
ECM

208
FUELING CONTROL PROPORTIONAL GAIN
510
512
514
516
526
528
FUEL CONTROLLER X1
518
SWITCH
522
520
RATE LIMITER
524
530
$Z^{-1}$
FUELING CONTROL INTEGRAL GAIN

APPARATUS AND METHOD FOR ACCURATELY CONTROLLING FUEL INJECTION FLOW RATE

TECHNICAL FIELD

The present invention relates to an apparatus and methods for fuel flow control in an internal combustion engine. More particularly, the present invention relates to a fuel flow control system which accommodates existing engine control architecture and controls fuel injection volume using gain switching to provide a stable yet responsive control of the fuel flow.

BACKGROUND OF THE INVENTION

In general, internal combustion engines having fuel injection devices are well known. With such engines, the precise amount of fuel to be injected and the timing of the fuel injection with respect to the position of the engine's pistons are crucial determinations in the control of the fuel injection system. Consequently, it is important to control the timing of fuel injection. It is equally important to precisely control the amount of fuel injected. The present invention provides a novel method and apparatus for controlling the amount of fuel injected into each cylinder.

Many conventional control systems for electronic fuel injectors turn the fuel injector on and off by the application thereto of electronic pulses having a prescribed pulse width. In such systems, the pulse width is determined on the basis of the engine rotational speed, the intake manifold pressure, fuel temperature, and other parameters of engine operation. The determined pulse width corresponds to the exact amount of fuel required by the engine operating under the sensed conditions. Such systems may use equations or maintain target values in a look-up table which translate the engine signals into projected fuel injection drive data. Feedback is then provided by comparing the projected fuel injection data with the actual fuel injection data to help adjust the fuel supply to meet the fuel demands of the engine. Over time, deterioration and wear change the engine's fuel demand characteristics. Under a given set of operating conditions, a greater or lesser quantity of fuel may thus be required than what was once required under identical conditions when the engine was new. Also, fuel system wear and deteriorating components may change the quantity of fuel supplied for a specific fuel injector setting. Therefore, feedback control allows the fuel injector control system to compensate for these changes in real time operation.

One such fuel delivery system utilizing feedback control is disclosed in U.S. Pat. No. 5,237,975 to Betki et al. Systems of this type control the amount of fuel applied to the cylinders primarily through varying the timing of injector actuation. Betki further discloses a feedback control method for maintaining a constant target pressure in the fuel line leading to the injectors. This control method effectively matches the actual differential pressure between the intake manifold and the fuel rail to a desired differential pressure, thereby maintaining a consistent fuel rail pressure.

Cummins Engine Company, the assignee of this patent, has developed a Pressure-Time (PT) fuel injection system which varies fuel rail pressure to control the quantity of fuel metered into the metering chamber of the injector. The timing of opening of an inlet port to the injector metering chamber is controlled by movement of the injector plunger. This opening timing affects the amount of fuel metered, but only secondarily. The pressure in the fuel rail is the primary determinant of the amount of fuel injected.

In systems of this type, the inventors have discovered that feedback control of fuel flow to the fuel injectors using the desired fuel rail pressure as a target has numerous disadvantages. First, the flow of fuel to the rail is controlled by signals sent to an actuator. Each actuator, when installed in an engine, has slightly different functional characteristics due to variations in the field produced by actuator coils, and other manufacturing tolerance variations. Thus, the same amount of current sent to two different actuators will generally result in different amounts of fuel injected. Thus, an offset determined by the feedback loop through comparison of actual to desired differential pressures may vary depending on the actuator.

The inventors have also found that pressure-based control is extremely sensitive to actuator variations, since pressure is non-linearly related to the electronic fuel control signal supplied to the actuator. This non-linear relationship results in the closed loop operation of the fuel controller being dependent on the changing pressure measurements, causing unstable fuel control as pressure changes. The use of pressure control also requires two conversion tables. The predicted fuel flow must be converted to a pressure value to perform the pressure comparisons for control, and the pressure value must then be converted to an electrical current to actuate the fuel controller. Since the combination of these mappings must be linear for stable gain determinations, the conversions must be carefully calibrated together to obtain a linear relationship. If the calibration does not harmonize the two mappings properly, erratic behavior will result and the speed stability can be adversely affected. Therefore, the inventors have determined that in such systems, there is a need for a new fuel control method based on a fuel controlling signal which is more linearly related to a control variable, such as the amount of fuel injected.

In prior fuel control systems, either engine speed or accelerator pedal position (torque) are generally used to determine the desired fuel injection volume. When fueling is controlled using the engine speed, the pressure feedback controller must have a low gain, or the feedback loop will become destabilized and the speed stability can be adversely affected. However, if the gain is too low, the fuel control system does not accurately respond to transients. Accordingly, the inventors have determined that there is a need for a controller which is able to provide appropriate gain levels for both speed and torque control modes.

In general, there is clearly a need for a fuel control system which provides for stable, effective feedback control of pressure in the fuel rail to thereby control the rate of fuel injection. Further, there is a need for a fuel control system which switches between gain determining modes to provide a more stable and robust fuel control.

SUMMARY OF THE INVENTION

Therefore, it is a general object of the present invention to provide an improved fuel flow control system which provides feedback control of a rate of fuel injection into the cylinders to match a target rate.

It is also an object of the present invention to overcome the aforementioned shortcomings associated with the prior art.

Another object of the present invention is to provide a stable yet responsive control of a fuel flow control system.

Yet another object of the present invention is to provide a fuel flow control system which is compatible with a standardized control architecture used across a variety of internal combustion engines.

A further object of the present invention is to provide a fuel flow control system which is tolerant of actuator and engine drift from original operating characteristics.

Yet another object of the present invention is to provide a fuel flow control system which provides different gains for different modes of engine operation, including a relatively low gain in a speed control mode and a more aggressive gain in a torque control mode.

It is also an object of the present invention to provide a fuel flow control system for an internal combustion engine in which the electrical fuel control signal is linearly related to the amount of fuel flowing to the fuel injectors.

Yet another object of the present invention is to provide a fueling control system in which fuel flow is regulated by matching a sensed fuel injection rate to a desired fuel rate using a feedback control loop.

A further object of the present invention is to provide a fuel flow control system wherein the gain of the fuel controller is determined by switching between control modes used to determine the fuel flow into the engine.

These as well as additional objects and advantages of the present invention are achieved by providing an improved system and method for controlling fuel injection rate in an internal combustion engine. The engine's electronic control module (ECM) senses engine operating parameters, such as engine speed, accelerator pedal position, temperature, etc., to determine a desired fuel flow rate under existing operating conditions. The desired fuel flow command is then converted into an estimate of required actuator current, using a fuel-to-current look-up table in a feedforward arrangement.

The actuator current controls the actuator control valve to inject the desired amount of fuel into the fuel rail. The applied actuator current is further adjusted using a proportional-integral feedback fuel controller, the output of which is combined with the feedforward estimate to obtain the desired fuel flow rate target. Differential pressure between the fuel rail and the intake manifold is sensed and converted into a corresponding sensed fuel flow value using a pressure-to-fuel flow look-up table stored in the ECM. A comparator determines the difference between the sensed fuel flow value and the desired fuel flow, and this difference is provided as an error signal to the proportional-integral controller. The proportional-integral controller generates a corrective current signal which is combined with the estimated current signal (from the feedforward circuit) to control the actuator. The feedback controller preferably switches between at least two separate gain determining modes, one mode having an aggressive set of gains and the other mode having a less aggressive set of gains. Preferably, the higher gain is used when the fuel flow control system uses torque to control engine operation, and the less aggressive mode is used when engine speed is the basis for controlling the engine.

DETAILED DESCRIPTION OF THE PREFERRED EMBODIMENTS

The present invention relates generally to a fueling control apparatus, and to methods for controlling fueling of an internal combustion engine by directly controlling fuel metering rate using a feedforward/feedback controller. The metering rate control is used to vary fuel rail pressure to obtain the desired quantity of fuel in each cycle in metering chambers of fuel injectors on the engine. The pressure in the fuel rail is the primary determinant of the amount of fuel injected, but the feedback controller controls the volume rate of injection to a desired value, rather than establishing a desired pressure in the fuel rail.

The engine is preferably controlled by an electronic control module (ECM) which determines desired fueling rates based on, among other factors, accelerator pedal position, engine speed, an idle speed governor setting, and a maximum RPM governor setting. For reasons which will be explained in more detail below, the inventors have found it desirable to define multiple operating modes for the engine fuel control. As will be seen, programmed operation of the fuel control system varies depending on the prevailing operating mode of the engine.

Figure 1:
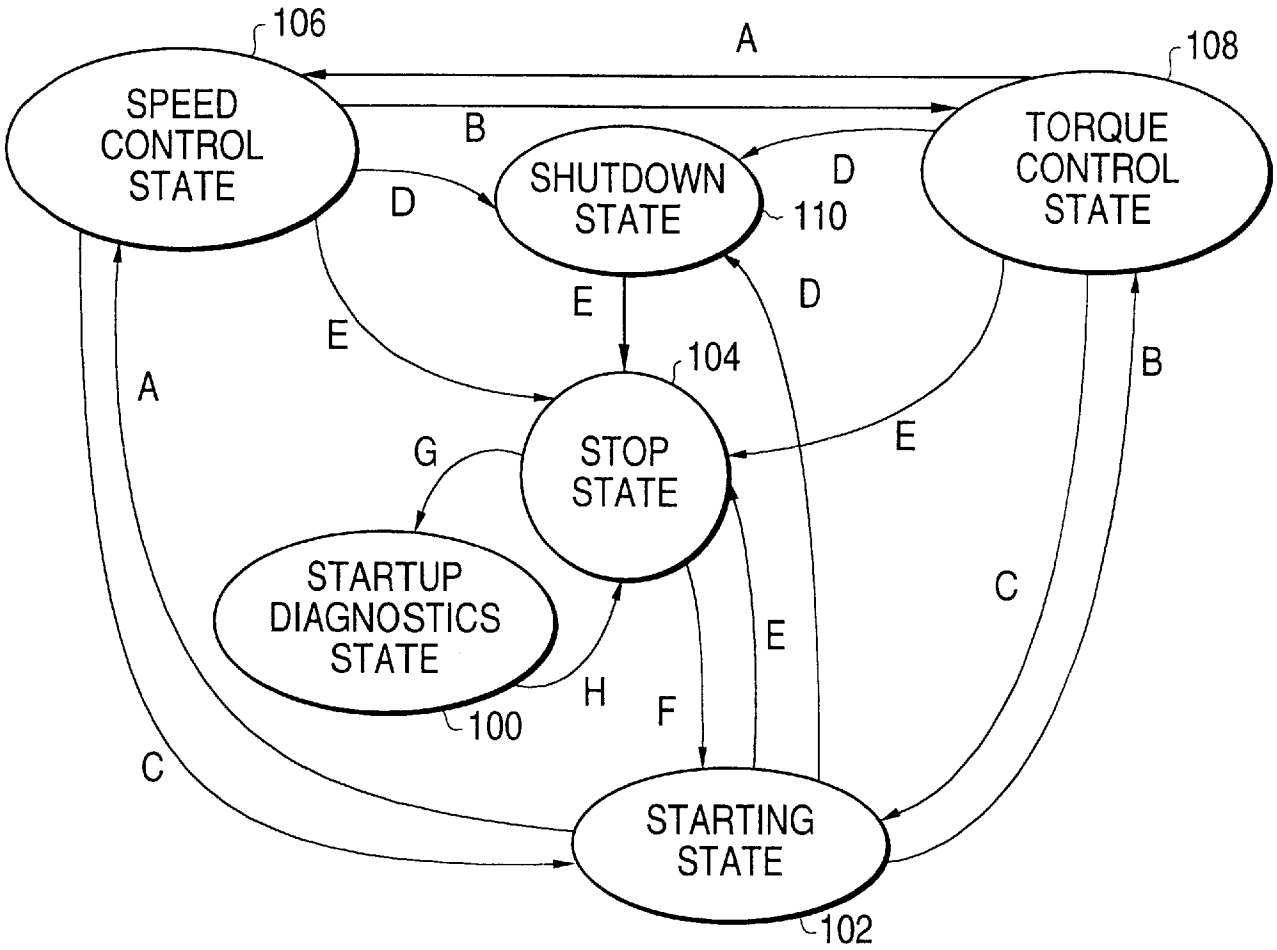
FIG. 1 is a state diagram showing switching between engine speed control and torque control modes in the present invention.

FIG. 1 is a state transition diagram showing the operating modes of the electronic control module of the present invention. As will be explained in more detail below, the operating state of the electronic control module is used to determine gain settings in the fuel controller.

As shown in FIG. 1, the engine control system used with the present invention preferably has six states: a startup diagnostics state 100, a starting state 102, a stop state 104, a speed control state 106, a torque control state 108, and a shutdown state 110. The control algorithm for determining the operating state of the fuel control system is stored in the memory of the ECM and executed by a microprocessor or similar microcontroller in the ECM.

The control algorithm has a plurality of input variables for determining the operating state of the fuel control system: the final fueling value, the average engine speed, the fueling control state, the minimum fueling, and engine diagnostics. The startup diagnostics state 100 is implemented upon power-up of the ECM. The starting state 102 is implemented when the fueling control state is in the crank state. The shutdown state 110 is active when the engine is being shut down but has not yet stopped, while the stop state 104 is active when the engine has stopped. The speed control state 106 is implemented by the fuel control system when fueling is being controlled by an engine speed governor, such as an idle speed control or a maximum RPM governor. The torque control state 108 is implemented when fueling is controlled by a something other than a speed governor, such as a accelerator pedal, AFC or torque curve. Therefore, other than when the engine is stopping and starting, the two main operating states of the fuel control system which determine the gain scheduling of the fuel controller are the speed control state 106 and the torque control state 108.

The fuel control system includes a timer to determine when to execute the transition to the startup diagnostics state 100 (designated by transition G in FIG. 1). The timer is started at power up and it continues to increment until it reaches its upper calibration time limit, at which point in time its output is frozen. If the diagnostics have not yet been performed, then the startup diagnostics state will be activated. After the startup diagnostics are completed as indicated by the engine diagnostic input variables giving OK-to-start readings, the fuel control system will switch to the stop state 104 in transition H.

After the engine is in a crank state and the startup diagnostics have been completed or if the engine is already running, the starting state 102 will become active in the fuel control system in transition F. When the engine speed governor is controlling fueling and the final fueling is greater than a predetermined minimum fueling, the fuel control system will switch to the speed control state 106 in transition A.

If the fueling control state is not in a crank state and the engine speed governors are not controlling engine operation, then the fuel control system will switch to the torque control state 108 in transition B. The fuel control system will also switch to the torque control state 108 in transition B when the final fueling input equals the minimum fueling input. In transition C, the fuel control system will switch back to the starting state 102 whenever the fueling control state equals the fueling crank state. When engine shutdown has been initiated, the fuel control system will switch to shutdown state 110 in transition D. Once the engine has completely stopped, the fuel control system will switch to stop state 104 in transition E.

Figure 2:
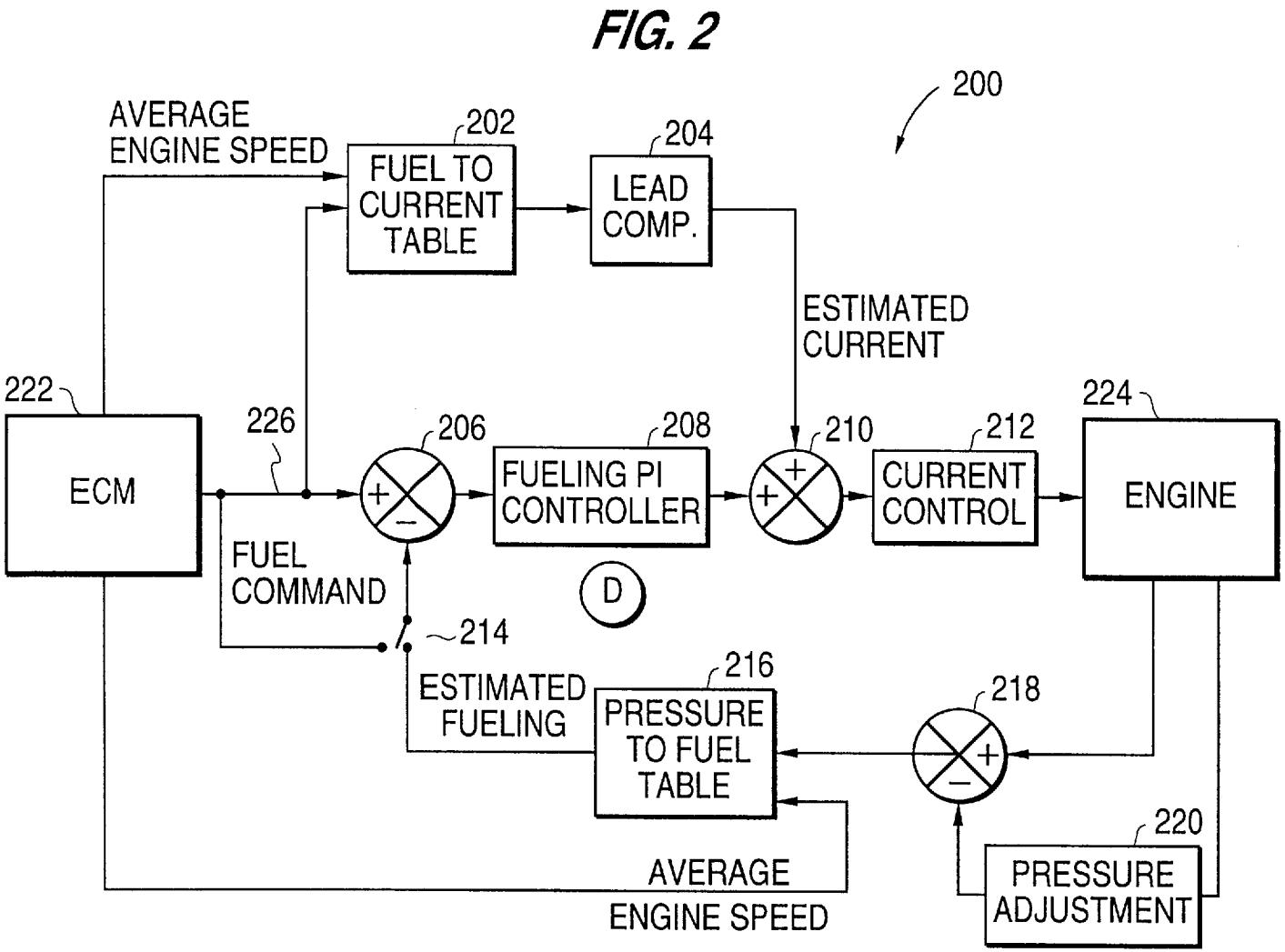
FIG. 2 is a block schematic diagram of a preferred embodiment of the control circuit according to the invention.

Referring now to FIG. 2, a novel fuel control system 200 is provided to control the rate of fuel injection in an internal combustion engine. The components of fuel control system 200 comprise fuel-to-current table 202, lead compensator 204, adder 206, proportional-integral controller 208, adder 210, current control 212, fault compensation switch 214, pressure-to-fuel table 216, adder 218, and pressure adjustment 220. Fuel control system 200 is connected to receive a fuel command signal from electronic control module 222. Fuel control system 200 is connected to provide feedback control of engine 224.

Electronic control module 222 performs conventional functions of monitoring engine and control operation through sensor, speed governing, and accelerator pedal inputs, calculating appropriate operating parameters using programmed algorithms, and generating control outputs to produce desired engine operation across a range of operating conditions. The significant output of electronic control module 222 with regard to fuel control according to the present invention is a fuel command 226; other, conventional control outputs and inputs of electronic control module 222 are omitted from the drawing.

Electronic control module 222 provides fuel command 226 as a desired fuel rate, in units of cubic millimeters of fuel to be injected into each cylinder in an injection event. Fuel control system 200 differs from conventional fuel control systems in that, rather than converting this desired fuel rate to a pressure and controlling to obtain that pressure, fuel control system 200 uses the desired fuel rate directly as a control target. Fuel control system 200 then accurately controls fuel injection in engine 224 to meet the specified fuel command target.

For explanatory purposes, the components of fuel control system 200 are shown in discrete form. However, in the preferred embodiment, the functions of fuel control system 200 as described below are implemented in firmware as part of the electronic control module 222.

Figure 3:
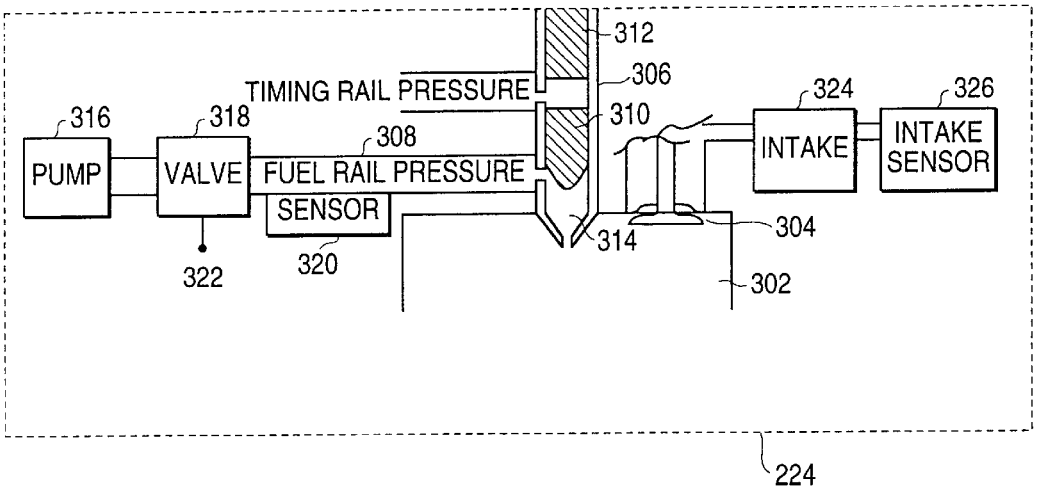
FIG. 3 is a block schematic diagram of the engine, fuel delivery actuators, and sensors controlled by the circuit of FIG. 2.

FIG. 3 shows the features of engine 224 that connect to fuel control system 200. As shown in FIG. 3, engine 224 comprises a plurality of combustion chambers 302, each having an intake valve 304 and a fuel injector 306. Intake valve 304 is connected to engine intake manifold 324, which is provided with a manifold pressure sensor 326. Fuel injector 306 may be, for example, a high pressure open-nozzle injector. Each of the plurality of fuel injectors 306 is connected to a common fuel rail 308. Lower plunger 310 and upper plunger 312 are controlled to open injection chamber 314 to fuel rail 308 for a defined period with specific timing, in each injection cycle. The amount of fuel entering injection chamber 314 in each injection cycle depends on the difference between the pressure in fuel rail 308 and the pressure of gas in combustion chamber 302, which is determined by intake manifold pressure. Thus, the amount of fuel injected may be controlled by controlling pressure in fuel rail 308.

Pressure in fuel rail 308 is established by a pump 316 with an associated pressure regulator (not shown). Pump 316 is separated from fuel rail 308 by a current-controlled linear actuator valve 318, which selectively pressurizes fuel rail 308 depending on the current supplied to terminal 322. A pressure sensor 320 is connected to sense pressure in fuel rail 308. Terminal 322 is connected to receive the output of current control 212 (shown in FIG. 2). A sensed pressure output of fuel rail pressure sensor 320 is connected to the positive input of adder 218 (shown in FIG. 2), while a sensed intake pressure output of intake sensor 326 is connected to pressure adjustment 220 (shown in FIG. 2) and thus to the negative input of adder 218. Engine 224 has numerous other components and sensors, such as engine speed and other sensors connected to electronic control module 222. These other components are conventional and are omitted for the sake of clarity.

The means of achieving control of fuel injection to provide a specified volume of fuel to injectors 306 for each injection event will now be explained in detail, with reference again to FIG. 2. As shown in FIG. 2, fuel command 226 is transmitted to fuel-to-current table 202, fault compensation switch 214, and adder 206.

Fuel-to-current table 202, along with lead compensator 204, generates an open loop, feedforward estimate of an appropriate actuator current for producing a desired movement of the linear actuator controlling fuel rail pressure. This estimate provides a quick response but cannot precisely determine the required current due to drift in engine and hydromechanical components. Fuel-to-current table 202 thus maps commanded fueling to a commanded current which is an approximation of the required current. In particular, fuel-to-current table 202 produces an output in units of current, based on inputs of (1) desired cubic millimeters of fuel per injection event (fuel command 226) and (2) average engine speed, which is obtained from electronic control module 222. A surface interpolation algorithm is used to determine the output value from the table values, based on the two input values. Sample values for fuel-to-current table 202, appropriate for a Cummins QSK-19 type power generation engine, are shown in Table A.

The output of fuel-to-current table 202 is provided to lead compensator 204. Lead compensator 204 is a digital filter that compensates for the generally slow response of rail pressure to changes in actuator current in transient states. Lead compensator 204 effectively increases the high frequency response of the fuel-to-current table output by providing a steady state gain of 1.0 and a higher frequency gain of approximately 2.0. When the rate of change in the fueling command is large, the resulting change in the calculated current estimate is made larger. As a result, when a high engine torque is desired, the current value will open the actuator beyond a point that would produce the desired fuel pressure under steady state conditions. As the fuel rail pressure approaches the desired level and the engine adjusts to its new commanded operation, the steady state gain will predominate in lead compensator 204, and the actuator will reduce its opening to a point that will produce the desired fuel pressure in the steady state.

Figure 4:
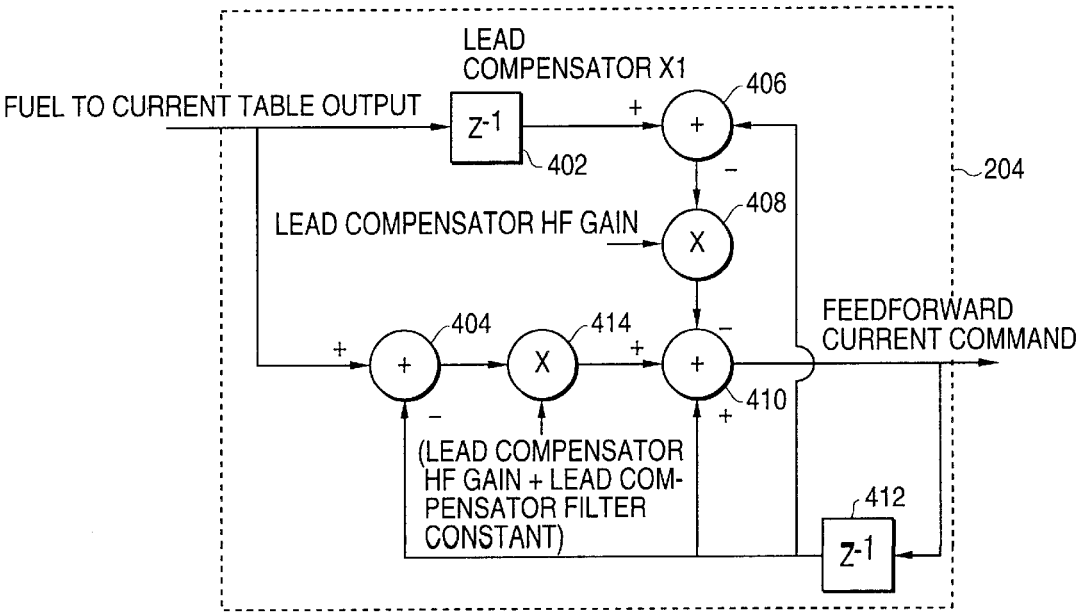
FIG. 4 is a block schematic diagram of a lead compensator used in the circuit of FIG. 2.

FIG. 4 is a diagram of a preferred embodiment of lead compensator 204. As shown in FIG. 4, the output of fuel-to-current table 202 is provided to lead compensator 204, and particularly to integrator 402 and adder 404. The output of integrator 402 is connected to adder 406, the output of which is connected to multiplier 408. Multiplier 408 preferably provides a high frequency gain of 1.7. The output of multiplier 408 is connected to a subtracting input of adder 410.

The output of adder 410 is the output of lead compensator 204, and is connected to adder 210 (shown in FIG. 2). The output of adder 410 is also connected to integrator 412. The output of integrator 412 is connected to a subtracting input of adder 406, to an additive input of adder 410, and to a subtracting input of adder 404.

The output of adder 404 is connected to multiplier 414. Multiplier 414 has a gain of 2.1, this being the sum of the high frequency gain of multiplier 408, and a filter constant of 0.4. The output of multiplier 414 is connected to an additive input of adder 410.

Referring again to FIG. 2, the output of lead compensator 204 is supplied as an input to adder 210, along with the output of proportional-integral controller 208. Proportional-integral controller 208 provides a feedback control input which adjusts the "estimate" of required actuator current provided by the feedforward calculation of fuel-to-current table 202 and lead compensator 204. Proportional-integral controller 208 and its feedback loop have the effect of compensating for variations in the current required to open different actuator valves to the same position.

The output of current control 212 is a pulse width modulated signal with a duty cycle which produces a desired total effective current which will produce the commanded fueling rate. In addition to providing PWM driver circuitry to perform this function, current control 212 preferably compensates for changes in battery voltage and ambient temperature. Changes in battery voltage might otherwise vary the required duty cycle of current to be applied to the actuator. In particular, as the battery voltage drops, the duty cycle must be increased to provide the same effective current to the actuator, assuming that resistance of the actuator is constant. Changes in ambient temperature tend to change effective actuator resistance in a non-linear fashion, resulting in a varying duty cycle requirement of the output. The provision of current control 212 substantially eliminates these non-linear factors so that the feedback control loop of fuel control system 200 need not compensate for these factors. The required-current-to-required-duty-cycle relationship is a known linear function. An approximation of resistance of the actuator is obtained by multiplying the slope of this linear function by battery voltage to produce a normalized slope (resistance) value. At low current levels, calculation of resistance in this manner is inhibited and a standard value is used, because the calculations become inaccurate at low current levels. In addition, the resistance calculation is heavily filtered to reduce noise. In addition, as current is applied, the calculated resistance value becomes momentarily erroneous because current lags voltage in the duty cycle step. For this reason, the calculated resistance is also rate limited as part of the filtering process. In this manner, a desired PWM current output is provided to engine 224.

The preferred construction of the feedback loop for proportional-integral controller 208 (comprising intake sensor 326, pressure sensor 320, pressure adjustment 220, adder 218, pressure-to-fuel table 216, and switch 214) will now be described in detail. The intake pressure measured by sensor 326 (shown in FIG. 3) is adjusted by pressure adjustment 220 before being transmitted to adder 218, where it is subtracted from the value of sensed rail pressure determined by pressure sensor 320 (shown in FIG. 3) to provide a differential pressure value as an input to pressure-to-fuel table 216.

The use of this differential pressure provides a significant advantage in the present invention. The inventors have determined that the amount of fuel injected depends on the difference between the fuel rail pressure and the intake manifold pressure, and not the fuel rail pressure alone. Due to the characteristics of the open nozzle injector, the fuel metering pressure must work against the cylinder pressure when metering. The cylinder pressure is closely related to the intake manifold pressure during the portion of the stroke when fuel metering occurs in the injector. This dependence remains valid during engine transients and during conditions of low ambient pressure (high altitude operation). That is, the fuel pressure required to obtain a desired fueling rate varies as a function of altitude. By using a differential pressure measurement for feedback control, the present invention compensates for the effects of transient boost pressure changes and altitude on the amount of fuel injected at a particular rail pressure.

Pressure adjustment 220 converts the output of sensor 326 from either a gage pressure reading or an absolute pressure reading, depending on the type of sensor used, to an estimate of absolute intake manifold pressure in units of pounds per square inch. Pressure adjustment 220 also compensates for failure in pressure sensor 326 by using an estimate of boost pressure if pressure sensor 326 is not operating properly. In this case, a lookup table internal to pressure adjustment 220 is used to provide the estimated value. The inputs to this lookup table are engine speed and current fuel rate, by which an estimate of steady state boost pressure is determined.

Pressure-to-fuel table 216 maps measured differential fuel rail pressure to fueling rate. Pressure-to-fuel table 216 produces an output in units of cubic millimeters of fuel per injection event, based on inputs of (1) differential pressure between the fuel rail and the engine intake manifold and (2) average engine speed, which is obtained from electronic control module 222. A surface interpolation algorithm is used to determine the output value from the table values, based on the two input values. Sample values for pressure-to-fuel table 216, appropriate for a Cummins QSK-19 type power generation engine, are shown in Table B.

The values in both Tables A and B are determined by empirically mapping the required rail pressures and duty cycles for operation of the specific engine. This data is preferably collected along constant settings of engine speed and injection timing to minimize the number of variables in the data. In this manner, appropriate conversion tables may be generated for any desired engine.

The output of pressure-to-fuel table 216 is transferred through switch 214 to adder 206. Switch 214 is normally set to pass the output of table 216 to adder 206. Preferably, the operation and outputs of the fuel rail pressure sensor and the intake manifold pressure sensor are monitored to determine whether either sensor is faulty. In the event of a failure of either pressure sensor, switch 214 disconnects the output of pressure-to-fuel table 216 from adder 206, and instead connects fuel command 226 to the subtracting input of adder 206. In this event, adder 206 produces a zero output and the error signal to proportional-integral controller 208 is set to zero. Proportional-integral controller 208 will then transition its output from its existing value to a default value, and that value will be used without change by virtue of the zero error signal provided by the operation of switch 214.

Figure 5:
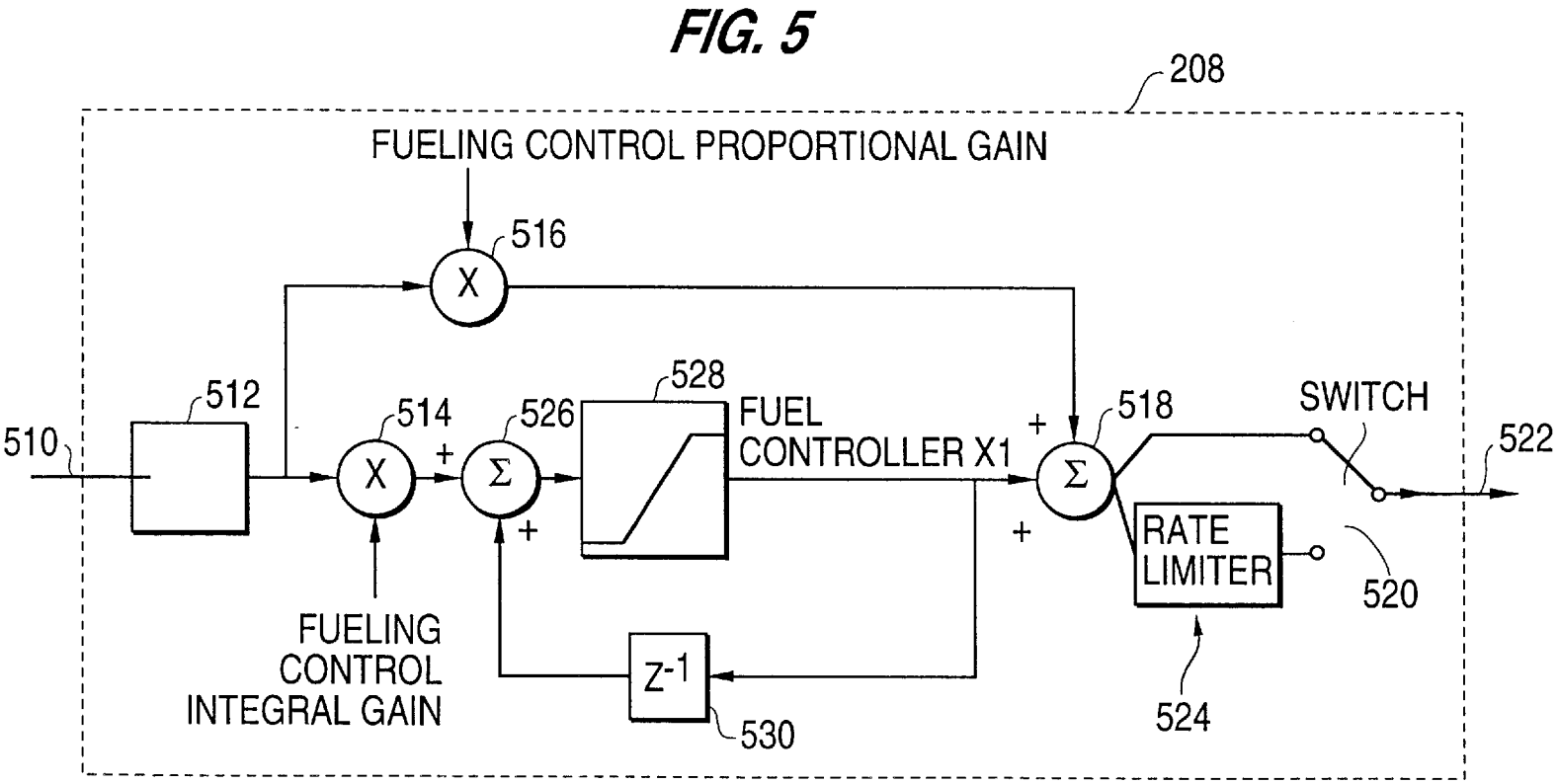
FIG. 5 is a block schematic diagram of a preferred embodiment of the proportional-integral controller shown in FIG. 2.

The design and operation of the preferred embodiment of proportional-integral controller 208 is shown in the block diagram of FIG. 5. Input 510 receives the output of adder 206 (shown in FIG. 2) and is connected to error limiter 512. The output of error limiter 512 is connected to integral gain multiplier 514 and to proportional gain multiplier 516. The output of proportional gain multiplier 516 is connected to adder 518. The output of adder 518 is connected through switch 520 to fueling current offset output 522. The output of adder 518 is also connected to rate limiter 524, the output of which is connected to switch 520. Switch 520 selectively connects fueling current offset output 522 to the output of adder 518 or to the rate-limited output of adder 518 provided by rate limiter 524. Fueling current offset output 522 provides the output of proportional-integral controller 208 and is connected to adder 210 (as shown in FIG. 2).

Switch 520 is activated to connect rate limiter 524 into the circuit if the rate of change of the output of adder 518 exceeds a predetermined rate. This functionality improves stability of operation.

The output of integral gain multiplier 514 is connected to an input of adder 526. The output of adder 526 is connected to limiter 528. The output of limiter 528 is connected to adder 518, and also through integrator 530 to adder 526.

Proportional-integral controller 208 is a feedback controller that generates a current offset representing the difference between the estimated current needed to obtain the desired fueling rate (taken from the output of lead compensator 204, shown in FIG. 2) and the actual required current. The fueling command 226 is used as the reference input to controller 208, and the estimated fueling value generated by pressure-to-fuel table 216 is the feedback input to controller 208.

Significantly, both proportional gain multiplier 516 and integral gain multiplier 514 have control inputs for selectively varying their gains depending on the engine operating state. This provides a gain scheduling feature which permits optimum operation of the engine in both governor-limited (speed control) and accelerator pedal-controlled (torque control) modes. The gains used by multipliers 514 and 516 are determined by the control state of the engine.

If engine operation is not on a governor, i.e. in the torque control mode, a more aggressive set of gains are preferably implemented. If operation is on a governor (speed control mode), a less aggressive gain should be implemented.

In the starting, shutdown, stop, and diagnostic states, "starting state" gains are used, such as 0.0010 Amp/mm$^3$/stroke for the proportional gain and 0.00001 Amp/mm$^3$/stroke for the integral gain. In the torque (fuel) control mode, for example, a proportional gain of 0.0005 Amp /mm$^3$/stroke and an integral gain of 0.00005 Amp/mm$^3$/stroke may be used. Exemplary gain values for the speed control mode are 0.0005 Amp/mm$^3$/stroke for proportional gain and 0.00001 Amp/mm$^3$/stroke for integral gain. As can be seen, the integral gain value for the torque control mode is approximately five times the value used in the speed control mode.

When the engine switches between modes, to avoid an abrupt shift in fueling, the gain change is implemented by a ramping process. An incremental gain value is established and the gains are changed by the incremental gain amount during each engine stroke until the new gain value is established. For example, the proportional gain may be ramped to the desired value in increments of 0.00010 Amp/mm$^3$/stroke, while the integral gain may be ramped in increments of 0.00001 Amp/mm$^3$/stroke.

This gain scheduling feature provides a significant advantage. Through study of the relevant systems, the inventors have found that closed loop rail pressure reaches the desired steady state value too slowly for desired operating purposes. Therefore, a reasonably high gain is needed to accurately track transients during engine operation. However, when the engine is operating in speed control mode, the control loop tends to destabilize with high gain. In this mode, engine control operation is based on sensed engine speed, and the engine speed is used within fuel control system 200 in addition to being the primary controlling feedback (around system 200) to the electronic control module. The inventors have determined that the limited level of gain that is appropriate for the speed control mode is lower than what is desirable for the torque control mode. By providing two different gains for these two different modes, it is possible to maintain stability in the speed control mode, and also produce engine operation that responds promptly to transients in the torque control mode.

If a stuck actuator or sensor fault is detected, such as a fault in sensors 320 or 326, the integrator value X1 (which is the output of limiter 528) is immediately reset to a default value. Output 522 is also reset to a default value, for example zero, but output 522 is preferably ramped to the default value by rate limiter 524.

The present invention, by directly controlling fuel flow rate as the target value rather than controlling for a desired fuel pressure, provides several significant advantages. First, this method provides a closed loop response time that is approximately independent of load, which increases accuracy. Second, calibration of the system is not especially sensitive to the linearity of composition of lookup tables, as in the case of feedback control systems that use pressure as the target. Thus, there has been disclosed an improved system and method for controlling fuel flow in an internal combustion engine.

TABLE A

FLOW-TO-CURRENT TABLE: Table values in AMPS

| | RPM: | 0.0 | 200.0 | 400.0 | 600.0 | 700.0 | 800.0 | 900.0 | 1100.0 |
|---|---|---|---|---|---|---|---|---|---|
| 0.00 | mm3/str | 0.4700 | 0.4700 | 0.4700 | 0.4700 | 0.4700 | 0.4700 | 0.4700 | 0.4700 |
| 19.99 | | 0.5070 | 0.5115 | 0.5143 | 0.5370 | 0.5215 | 0.5264 | 0.5334 | 0.5472 |
| 40.01 | | 0.5229 | 0.5260 | 0.5311 | 0.5341 | 0.5399 | 0.5444 | 0.5520 | 0.5663 |
| 60.00 | | 0.5399 | 0.5446 | 0.5479 | 0.5510 | 0.5565 | 0.5624 | 0.5706 | 0.5853 |
| 79.99 | | 0.5551 | 0.5610 | 0.5647 | 0.5680 | 0.5740 | 0.5904 | 0.5990 | 0.6042 |

TABLE A-continued

| FLOW-TO-CURRENT TABLE: Table values in AMPS | | | | | | | | | |
|---|---|---|---|---|---|---|---|---|---|
| 100.01 | | 0.5710 | 0.5775 | 0.5815 | 0.5950 | 0.5916 | 0.5984 | 0.6075 | 0.6233 |
| 124.99 | | 0.5909 | 0.5991 | 0.6025 | 0.6062 | 0.6134 | 0.6209 | 0.6306 | 0.6471 |
| 150.00 | | 0.6110 | 0.6398 | 0.6235 | 0.6274 | 0.6353 | 0.6434 | 0.6539 | 0.6708 |
| 175.01 | | 0.6310 | 0.6394 | 0.6445 | 0.6489 | 0.6571 | 0.6659 | 0.6769 | 0.6946 |
| 195.99 | | 0.6510 | 0.6600 | 0.6655 | 0.6700 | 0.6790 | 0.6884 | 0.6999 | 0.7183 |
| 225.00 | | 0.6710 | 0.6905 | 0.6865 | 0.6913 | 0.7009 | 0.7109 | 0.7231 | 0.7431 |
| 250.01 | | 0.6910 | 0.7033 | 0.7075 | 0.7125 | 0.7228 | 0.7334 | 0.7443 | 0.7457 |
| 214.99 | | 0.7111 | 0.7219 | 0.7295 | 0.7338 | 0.7446 | 0.7559 | 0.7694 | 0.7895 |
| 300.00 | | 0.7310 | 0.7426 | 0.7495 | 0.7550 | 0.7665 | 0.7794 | 0.7925 | 0.8134 |
| 325.01 | | 0.7510 | 0.7631 | 0.7705 | 0.7762 | 0.7995 | 0.8009 | 0.9155 | 0.9372 |
| 349.99 | | 0.7710 | 0.7839 | 0.7915 | 0.7975 | 0.9103 | 0.8234 | 0.9367 | 0.8609 |
| 375.00 | | 0.7910 | 0.9044 | 0.8125 | 0.9188 | 0.9322 | 0.8459 | 0.9619 | 0.8946 |
| 400.01 | | 0.8110 | 0.8249 | 0.8335 | 0.8400 | 0.8540 | 0.9694 | 0.9850 | 0.9083 |
| 450.00 | | 0.8509 | 0.8663 | 0.8755 | 0.9824 | 0.9978 | 0.9134 | 0.9313 | 0.9559 |
| 600.00 | | 0.9709 | 0.9900 | 1.0015 | 1.0100 | 1.0291 | 1.0495 | 1.0699 | 1.0993 |
| | RPM: | 1300.0 | 1500.0 | 1800.0 | 1900.0 | 2100.0 | 2300.0 | 4000.0 | |
| 0.00 | mm3/str | 0.4700 | 0.4700 | 0.4700 | 0.4700 | 0.4700 | 0.4700 | 0.4700 | |
| 19.99 | | 0.5500 | 0.5535 | 0.5570 | 0.5620 | 0.5673 | 0.5771 | 0.6392 | |
| 40.01 | | 0.5699 | 0.5745 | 0.5790 | 0.5950 | 0.5912 | 0.6022 | 0.6652 | |
| 60.00 | | 0.5900 | 0.5955 | 0.6010 | 0.6090 | 0.6152 | 0.6252 | 0.6912 | |
| 79.99 | | 0.6100 | 0.6165 | 0.6230 | 0.6310 | 0.6392 | 0.6492 | 0.7172 | |
| 100.01 | | 0.6300 | 0.6374 | 0.6450 | 0.6541 | 0.6632 | 0.6732 | 0.7432 | |
| 124.99 | | 0.6550 | 0.6639 | 0.6725 | 0.6929 | 0.6932 | 0.7032 | 0.7758 | |
| 150.00 | | 0.6801 | 0.6999 | 0.6999 | 0.7115 | 0.7231 | 0.7332 | 0.8092 | |
| 175.01 | | 0.7050 | 0.7163 | 0.7275 | 0.7404 | 0.7532 | 0.7632 | 0.9403 | |
| 195.99 | | 0.7300 | 0.7426 | 0.7550 | 0.7690 | 0.7932 | 0.7932 | 0.9732 | |
| 225.00 | | 0.7550 | 0.7688 | 0.7825 | 0.7979 | 0.9132 | 0.9232 | 0.9059 | |
| 250.01 | | 0.7900 | 0.7950 | 0.9101 | 0.9265 | 0.9433 | 0.8531 | 0.9392 | |
| 214.99 | | 0.9051 | 0.8213 | 0.8375 | 0.9553 | 0.9732 | 0.8832 | 0.9707 | |
| 300.00 | | 0.9300 | 0.9475 | 0.9650 | 0.9840 | 0.9032 | 0.9132 | 1.0032 | |
| 325.01 | | 0.8550 | 0.8739 | 0.9925 | 0.9128 | 0.9332 | 0.9432 | 1.0356 | |
| 349.99 | | 0.9800 | 0.9000 | 0.9200 | 0.9415 | 0.9633 | 0.9731 | 1.0692 | |
| 375.00 | | 0.9050 | 0.9263 | 0.9475 | 0.9703 | 0.9932 | 1.0032 | 1.1007 | |
| 400.01 | | 0.9301 | 0.9525 | 0.9750 | 0.9990 | 1.0232 | 1.0332 | 1.1332 | |
| 450.00 | | 0.9900 | 1.0050 | 1.0300 | 1.0565 | 1.0932 | 1.0933 | 2.1992 | |
| 600.00 | | 1.1300 | 1.1625 | 1.1949 | 1.2290 | 1.2632 | 1.2732 | 1.3932 | |

TABLE B

| PRESSURE-TO-FLOW TABLE: Table value in MM3/STR | | | | | | | | | | | | | | |
|---|---|---|---|---|---|---|---|---|---|---|---|---|---|---|
| RPM: | 0.00 | 200.00 | 400.00 | 600.00 | 800.00 | 1050.00 | 1300.00 | 1400.00 | 1500.00 | 1650.00 | 1800.00 | 1900.00 | 2100.00 | 4000.00 |
| 0.00 psi | 19.99 | 19.99 | 19.99 | 19.99 | 19.99 | 19.99 | 19.99 | 19.99 | 19.99 | 19.99 | 19.99 | 19.99 | 19.99 | 19.99 |
| 1.00 | 65.18 | 65.18 | 32.58 | 21.73 | 19.99 | 19.99 | 19.99 | 19.99 | 19.99 | 19.99 | 19.99 | 19.99 | 19.99 | 19.99 |
| 2.00 | 128.98 | 128.98 | 64.50 | 42.98 | 32.25 | 24.56 | 19.99 | 19.99 | 19.99 | 19.99 | 19.99 | 19.99 | 19.99 | 19.99 |
| 3.00 | 191.44 | 191.44 | 95.72 | 63.82 | 47.86 | 36.47 | 29.46 | 27.35 | 25.52 | 23.20 | 21.28 | 20.16 | 19.99 | 19.99 |
| 4.00 | 252.59 | 252.59 | 126.28 | 84.19 | 63.14 | 48.12 | 36.86 | 36.07 | 33.68 | 30.61 | 28.05 | 26.60 | 24.07 | 19.99 |
| 5.00 | 312.45 | 312.45 | 156.21 | 104.16 | 78.12 | 59.51 | 48.07 | 44.63 | 41.65 | 37.88 | 34.71 | 32.88 | 29.77 | 19.99 |
| 7.00 | 428.39 | 428.39 | 214.20 | 142.80 | 107.11 | 81.61 | 65.91 | 61.20 | 57.12 | 51.94 | 47.60 | 45.09 | 40.80 | 21.42 |
| 10.00 | 593.32 | 593.32 | 296.65 | 197.77 | 148.34 | 113.02 | 91.29 | 84.75 | 79.10 | 71.93 | 65.93 | 62.46 | 56.51 | 29.67 |
| 15.00 | 700.01 | 700.01 | 422.88 | 261.93 | 211.43 | 161.11 | 130.13 | 120.82 | 112.78 | 102.52 | 93.98 | 89.04 | 80.55 | 42.28 |
| 20.00 | 700.01 | 700.01 | 536.39 | 357.61 | 268.20 | 204.35 | 165.05 | 153.26 | 143.04 | 130.03 | 119.20 | 112.92 | 102.16 | 53.65 |
| 30.00 | 700.01 | 700.01 | 700.01 | 487.22 | 365.44 | 278.41 | 224.88 | 208.80 | 194.88 | 177.19 | 162.40 | 153.87 | 139.22 | 73.10 |
| 40.00 | 700.01 | 700.01 | 700.01 | 593.65 | 445.24 | 339.23 | 273.98 | 254.41 | 237.47 | 215.86 | 197.88 | 187.48 | 169.62 | 89.04 |
| 60.00 | 700.01 | 700.01 | 700.01 | 700.01 | 570.56 | 434.72 | 351.12 | 326.04 | 304.29 | 276.63 | 253.57 | 240.23 | 217.36 | 114.12 |
| 80.00 | 700.01 | 700.01 | 700.01 | 700.01 | 674.06 | 513.59 | 414.82 | 385.17 | 359.51 | 326.81 | 299.60 | 283.83 | 256.78 | 134.81 |
| 90.00 | 700.01 | 700.01 | 700.01 | 700.01 | 700.01 | 551.93 | 465.78 | 413.93 | 386.34 | 351.21 | 321.96 | 305.02 | 275.95 | 144.89 |
| 130.00 | 700.01 | 700.01 | 700.01 | 700.01 | 700.01 | 700.01 | 583.34 | 541.66 | 505.55 | 459.59 | 421.29 | 399.12 | 361.10 | 189.59 |
| 170.00 | 700.01 | 700.01 | 700.01 | 700.01 | 700.01 | 700.01 | 700.01 | 682.13 | 636.66 | 578.77 | 530.53 | 502.62 | 454.76 | 238.73 |
| 380.00 | 700.01 | 700.01 | 700.01 | 700.01 | 700.01 | 700.01 | 700.01 | 700.01 | 664.22 | 603.84 | 553.52 | 524.39 | 474.45 | 249.09 |
| 220.00 | 700.01 | 700.01 | 700.01 | 700.01 | 700.01 | 700.01 | 700.01 | 700.01 | 694.64 | 631.50 | 578.86 | 548.39 | 496.17 | 260.48 |

We claim:

1. A fuel control system for an internal combustion engine for delivering fuel to a fuel rail for distribution to a plurality of fuel injectors, comprising:

computing means for receiving a plurality of operating condition signals indicative of an operating state of the internal combustion engine and for generating a desired fuel quantity signal representing a desired quantity of fuel to be delivered to one of the fuel injectors based on said operating condition signals;

first conversion means connected with said computing means for converting said desired fuel quantity signal into an estimated actuator current signal;

adjusting means connected with said first conversion means and an output of a proportional integral controller means for combining an offset current signal received from said proportional integral controller means with said estimated actuator current signal to produce an actuator current control signal;

actuator means connected with said adjusting means for receiving said actuator current control signal and for controlling the amount of fuel delivered to the fuel rail based on said actuator current control signal;

pressure sensing means connected with the fuel rail for sensing a fuel pressure in the fuel rail and for generating a fuel rail pressure signal corresponding to said fuel pressure;

second conversion means connected with said pressure sensing means for receiving said fuel rail pressure signal and for converting said fuel rail pressure signal into an estimated fuel quantity signal representing an estimated actual fuel delivery rate to one of the injectors; and comparison means connected with said second conversion means, said computing means and said proportional integral controller means for generating a fuel quantity error signal corresponding to a difference between said estimated fuel quantity signal and said desired fuel quantity signal and for providing said fuel quantity error signal to said proportional integral controller means;

wherein said proportional integral controller means generates an offset current signal based on said fuel quantity error signal.

2. A method of controlling a quantity of fuel injected into a cylinder of an internal combustion engine during each injection event comprising the steps of:

generating a desired fuel quantity signal indicative of a desired fuel quantity to be delivered to the cylinder of the internal combustion engine;

generating an estimated actuator current signal from said desired fuel quantity signal, said estimated actuator current signal being indicative of an estimated actuator current necessary to deliver said desired fuel quantity to a cylinder of the internal combustion engine;

generating a fuel rail pressure signal indicative of a measured fuel rail pressure;

generating an actual fuel quantity signal from said fuel rail pressure signal, said actual fuel quantity signal being indicative of an actual fuel quantity delivered to a cylinder of the internal combustion engine;

generating a fuel quantity difference signal representing a difference between said desired fuel quantity signal and said actual fuel quantity signal;

generating an actuator current difference signal from said fuel quantity difference signal, said actuator current difference signal being indicative of a difference between said estimated actuator current and an actual actuator current necessary to achieve delivery of said desired fuel quantity to a cylinder of the internal combustion engine;

combining said estimated actuator current signal and said actuator current difference signal to generate an actual actuator current signal indicative of said actual actuator current; and controlling an actuator in accordance with said actual actuator current signal.

3. The method of claim 2 wherein the quantity of fuel injected into the cylinder of the internal combustion engine is controlled by said fuel rail pressure, and said fuel rail pressure is varied in accordance with said desired fuel quantity to be delivered to the cylinder of the internal combustion engine.

4. The method of claim 3 wherein said measured fuel rail pressure is a differential fuel rail pressure and said step of generating a fuel rail pressure signal indicative of a measured fuel rail pressure comprises the steps of:

measuring a sensed fuel rail pressure;

measuring an intake manifold pressure;

calculating a differential fuel rail pressure equal to a difference between said sensed fuel rail pressure and said intake manifold pressure; and generating said fuel rail pressure signal indicative of said differential fuel rail pressure.

5. The method of claim 4 wherein said step of calculating a differential fuel rail pressure includes the step of processing said intake manifold pressure to generate an estimate of absolute intake manifold pressure and said differential fuel rail pressure is equal to a difference between said sensed fuel rail pressure and said estimate of absolute intake manifold pressure.

6. The method of claim 5 wherein said intake manifold pressure is a gage pressure.

7. The method of claim 5 wherein said intake manifold pressure is an absolute pressure.

8. The method of claim 3 wherein said measured fuel rail pressure is a differential fuel rail pressure and said step of generating a fuel rail pressure signal indicative of a measured fuel rail pressure comprises the steps of:

measuring a sensed fuel rail pressure;

generating an estimate of boost pressure;

calculating a differential fuel rail pressure equal to a difference between said sensed fuel rail pressure and said estimate of boost pressure; and generating said fuel rail pressure signal indicative of said differential fuel rail pressure.

9. The method of claim 8 wherein said step of generating an estimate of boost pressure includes the step of accessing a look-up table in response to measured engine operating parameters.

10. The method of claim 9 wherein said engine operating parameters include at least one of engine speed and current fuel rate.

11. The method of claim 3 wherein said measured fuel rail pressure is a differential fuel rail pressure and said step of generating a fuel rail pressure signal indicative of a measured fuel rail pressure comprises the steps of:

measuring a sensed fuel rail pressure;

determining the operational status of an intake manifold pressure sensor;

measuring, when said operational status indicates proper operation of the intake manifold pressure sensor, an intake manifold pressure and calculating a differential fuel rail pressure equal to a difference between said sensed fuel rail pressure and said intake manifold pressure;

generating when said operational status indicates a failure of said intake manifold pressure sensor, an estimate of boost pressure and calculating a differential fuel rail pressure equal to a difference between said sensed fuel rail pressure and said estimate of boost pressure; and generating said fuel rail pressure signal indicative of said differential fuel rail pressure.

12. The method of claim 2 wherein said step of generating an actual fuel quantity signal comprises the steps of receiving an average engine speed signal indicative of an average engine speed and accessing a look-up table using said average engine speed signal and said fuel rail pressure signal to retrieve data representing said actual fuel quantity delivered to the cylinder of the internal combustion engine.

13. The method of claim 2 wherein said fuel quantity signal is generated in response to measured engine operating parameters.

14. The method of claim 13 wherein said engine operating parameters include at least one of engine speed, accelerator pedal position, idle speed governor setting, maximum RPM governor setting, and temperature.

15. The method of claim 2 further comprising the step of determining an operating state of the internal combustion engine and wherein said step of generating an actuator current difference signal includes the step of selecting at least one gain in accordance with said operating state, said gain being used in a proportional-integral controller to generate said actuator current difference signal.

16. The method of claim 15 wherein said operating state is one of a speed control state, a torque control state, and a starting state.

17. The method of claim 16 wherein said at least one gain is a proportional gain of said proportional-integral controller.

18. The method of claim 17 wherein said operating state is said speed control state and said proportional gain is 0.0005 Amp/mm$^3$/stroke.

19. The method of claim 17 wherein said operating state is said torque control state and said proportional gain is 0.0005 Amp/mm$^3$/stroke.

20. The method of claim 17 wherein said operating state is said starting state and said proportional gain is 0.0010 Amp/mm$^3$/stroke.

21. The method of claim 16 wherein said at least one gain is an integral gain of said proportional-integral controller.

22. The method of claim 21 wherein said operating state is said speed control state and said integral gain is 0.00001 Amp/mm$^3$/stroke.

23. The method of claim 21 wherein said operating state is said torque control state and said integral gain is 0.00005 Amp/mm$^3$/stroke.

24. The method of claim 21 wherein said operating state is said starting state and said integral gain is 0.00001 Amp/mm$^3$/stroke.

25. The method of claim 15 further comprising the step of detecting a change in operating state of the internal combustion engine from a first operating state to a second operating state and said step of selecting at least one gain in accordance with said operating state includes the step of establishing at least one incremental gain value used to incrementally vary said at least one gain from a first value corresponding to said first operating state to a second value corresponding to said second operating state.

26. The method of claim 25 wherein said at least one gain is a proportional gain of said proportional-integral controller and said incremental gain value is 0.00010 Amp/mm$^3$/stroke.

27. The method of claim 25 wherein said at least one gain is an integral gain of said proportional-integral controller and said incremental gain value is 0.00001 Amp/mm$^3$/stroke.

28. A system for controlling a quantity of fuel injected from a fuel rail into a cylinder of an internal combustion engine during each injection event, wherein the fuel pressure in the fuel rail is varied using an actuator to control the desired quantity of fuel to be injected into the cylinder of the internal combustion engine, comprising:

processing means for generating a desired fuel quantity signal indicative of a desired fuel quantity to be delivered to the cylinder of the internal combustion engine;

fuel-to-current conversion means connected with said processing means for receiving said desired fuel quantity signal and generating an estimated actuator current signal from said desired fuel quantity signal, said estimated actuator current signal being indicative of an estimated actuator current necessary to deliver said desired fuel quantity to the cylinder of the internal combustion engine during the injection event;

fuel rail pressure measuring means connected with the fuel rail of the internal combustion engine for measuring a sensed fuel rail pressure and for generating a fuel rail pressure signal in response thereto;

pressure-to-fuel conversion means connected with said fuel rail pressure measuring means for receiving said fuel rail pressure signal and for generating an actual fuel quantity signal from said fuel rail pressure signal, said actual fuel quantity signal being indicative of an actual fuel quantity delivered to a cylinder of the internal combustion engine;

first comparison means connected with said processing means and said pressure-to-fuel conversion means for receiving said desired fuel quantity signal and said actual fuel quantity signal, for calculating a difference between said desired fuel quantity signal and said actual fuel quantity signal, and for generating a fuel quantity difference signal representing said difference;

controller means connected with said first comparison means for receiving said fuel quantity difference signal and for generating an actuator current difference signal from said fuel quantity difference signal, said actuator current difference signal being indicative of a difference between said estimated actuator current and an actual actuator current necessary to achieve delivery of said desired fuel quantity to a cylinder of the internal combustion engine;

second comparison means connected with said controller means and said fuel-to-current conversion means for receiving said estimated actuator current signal and said actuator current difference signal, and for combining said estimated actuator current signal and said actuator current difference signal to generate an actual actuator current signal indicative of said actual actuator current; and current control means connected with said second comparison means for controlling the supply of current to the actuator in accordance with said actual actuator current signal.

29. The system of claim 28 wherein said sensed fuel rail pressure is a differential fuel rail pressure and said fuel rail pressure measuring means further comprises:

intake manifold pressure measuring means for measuring an intake manifold pressure;

pressure processing means connected with said intake manifold pressure measuring means and said fuel rail pressure measuring means for calculating a differential fuel rail pressure equal to a difference between said sensed fuel rail pressure and said intake manifold pressure, and for generating said fuel rail pressure signal indicative of said differential fuel rail pressure.

30. The system of claim 29 wherein said pressure processing means further operates to process said intake manifold pressure to generate an estimate of absolute intake manifold pressure and said differential fuel rail pressure is equal to a difference between said sensed fuel rail pressure and said estimate of absolute intake manifold pressure.

31. The system of claim 30 wherein said intake manifold pressure is a gage pressure.

32. The system of claim 30 wherein said intake manifold pressure is an absolute pressure.

33. The system of claim 28 wherein said sensed fuel rail pressure is a differential fuel rail pressure and said fuel rail pressure measuring means further comprises:

boost pressure estimating means for generating an estimate of boost pressure;

pressure processing means for calculating a differential fuel rail pressure equal to a difference between said sensed fuel rail pressure and said estimate of boost pressure and, for generating said fuel rail pressure signal indicative of said differential fuel rail pressure.

34. The system of claim 33 wherein said boost pressure estimating means further operates to access a look-up table in response to measured engine operating parameters.

35. The system of claim 34 wherein said engine operating parameters include at least one of engine speed and current fuel rate.

36. The system of claim 28 wherein said sensed fuel rail pressure is a differential fuel rail pressure and said fuel rail pressure measuring means further comprises:

sensor error detecting means for determining the operational status of an intake manifold pressure sensor and generating a sensor status signal indicative thereof;

pressure processing means connected with said sensor error detecting means for receiving said sensor status signal and when said sensor status signal indicates proper operation of the intake manifold pressure sensor, for measuring an intake manifold pressure and calculating a differential fuel rail pressure equal to a difference between said sensed fuel rail pressure and said intake manifold pressure, and when said sensor status signal indicates a failure of said intake manifold pressure sensor, for generating an estimate of boost pressure and calculating a differential fuel rail pressure equal to a difference between said sensed fuel rail pressure and said estimate of boost pressure, and for generating said fuel rail pressure signal indicative of said differential fuel rail pressure.

37. The system of claim 28 wherein said pressure-to-fuel conversion means further operates to receive an average engine speed signal indicative of an average engine speed and to access a look-up table using said average engine speed signal and said fuel rail pressure signal to retrieve data representing said actual fuel quantity delivered to the cylinder of the internal combustion engine.

38. The system of claim 28 wherein said processing means further operates to receive measured engine operating parameters and wherein said desired fuel quantity signal is generated in response to said measured engine operating parameters.

39. The system of claim 38 wherein said engine operating parameters include at least one of engine speed, accelerator pedal position, idle speed governor setting, maximum RPM governor setting, and temperature.

40. The system of claim 28 wherein said controller means comprises a proportional-integral controller and further operates to receive operating state data representing an operating state of the internal combustion engine and selects at least one gain in accordance with said operating state data, said gain being used in said proportional-integral controller to generate said actuator current difference signal.

41. The system of claim 40 wherein said operating state is one of a speed control state, a torque control state, and a starting state.

42. The system of claim 41 wherein said at least one gain is a proportional gain of said proportional-integral controller.

43. The system of claim 42 wherein said operating state is said speed control state and said proportional gain is 0.0005 Amp/mm$^3$/stroke.

44. The system of claim 42 wherein said operating state is said torque control state and said proportional gain is 0.0005 Amp/mm$^3$/stroke.

45. The system of claim 42 wherein said operating state is said starting state and said proportional gain is 0.0010 Amp/mm$^3$/stroke.

46. The system of claim 41 wherein said at least one gain is an integral gain of said proportional-integral controller.

47. The system of claim 46 wherein said operating state is said speed control state and said integral gain is 0.00001 Amp/mm$^3$/stroke.

48. The system of claim 46 wherein said operating state is said torque control state and said integral gain is 0.00005 Amp/mm$^3$/stroke.

49. The system of claim 46 wherein said operating state is said starting state and said integral gain is 0.00001 Amp/mm$^3$/stroke.

50. The system of claim 40 wherein said controller means further operates to detect a change in operating state of the internal combustion engine from a first operating state to a second operating state and operates to select said at least one gain in accordance with said operating state by establishing at least one incremental gain value used to incrementally vary said at least one gain from a first value corresponding to said first operating state to a second value corresponding to said second operating state.

51. The system of claim 50 wherein said at least one gain is a proportional gain of said proportional-integral controller and said incremental gain value is 0.00010 Amp/mm$^3$/stroke.

52. The system of claim 50 wherein said at least one gain is an integral gain of said proportional-integral controller and said incremental gain value is 0.00001 Amp/mm$^3$/stroke.

* * * * *